US008764465B2

(12) United States Patent
Huang

(10) Patent No.: US 8,764,465 B2
(45) Date of Patent: Jul. 1, 2014

(54) CONNECTOR MECHANISM HAVING A PIVOTABLY DISPOSED COVER AND A RESILIENT COMPONENT ENGAGING THE COVER

(71) Applicant: Wistron Corporation, New Taipei (TW)

(72) Inventor: Hung-Ming Huang, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 28 days.

(21) Appl. No.: 13/652,434

(22) Filed: Oct. 15, 2012

(65) Prior Publication Data

US 2014/0057485 A1 Feb. 27, 2014

(30) Foreign Application Priority Data

Aug. 22, 2012 (TW) ..... 101130482 A
Aug. 22, 2012 (TW) ..... 101130486 A

(51) Int. Cl.
*H01R 13/44* (2006.01)

(52) U.S. Cl.
USPC ..... 439/138

(58) Field of Classification Search
CPC ..... H01R 13/6275; H01R 13/6273; H01R 13/62938; H01R 13/62955; H01R 13/62933; H01R 13/447; H01R 13/453
See application file for complete search history.

(56) References Cited

U.S. PATENT DOCUMENTS 4,037,907 A * 7/1977 Klimek et al. ..... 439/142
5,002,495 A * 3/1991 Tanaka ..... 439/108
5,694,290 A * 12/1997 Chang ..... 361/679.31
6,247,849 B1 * 6/2001 Liu ..... 385/55
6,869,297 B2 * 3/2005 Caveney ..... 439/138
7,364,444 B2 4/2008 Kellock
8,337,222 B2 * 12/2012 Hung et al. ..... 439/138
2010/0248554 A1 9/2010 Hung

FOREIGN PATENT DOCUMENTS

TW I340510 4/2011
TW M409594 U1 8/2011
TW M418437 U1 12/2011
TW M422777 2/2012

OTHER PUBLICATIONS

Office action mailed on Mar. 26, 2014 for the Taiwan application No. 101130482, filing date: Aug. 22, 2012, p. 1 line 6~14, p. 2~5 and p. 6 line 1~5.

* cited by examiner

*Primary Examiner* — Chandrika Prasad
(74) *Attorney, Agent, or Firm* — Winston Hsu; Scott Margo

(57) ABSTRACT

A connector mechanism includes a base, a cover and a resilient component. An opening is formed on the base, and an external plug can inset into the opening. The cover is pivotably disposed on the base. The cover includes a first portion, a second portion and an axle. The first portion rotates to a first position for covering the opening, and further rotates to a second position to hold a body of the external plug. The second portion includes a buckling structure for buckling a pin of the external plug when the first portion rotates to the second position, so as to constrain a movement of the external plug relative to the base. Two ends of the resilient component respectively contact against the base and the cover, and the cover can cover the opening via a resilient recovering force of the resilient component.

21 Claims, 16 Drawing Sheets

CONNECTOR MECHANISM HAVING A PIVOTABLY DISPOSED COVER AND A RESILIENT COMPONENT ENGAGING THE COVER

BACKGROUND OF THE INVENTION

1. Field of the Invention

The present disclosure relates to a connector mechanism, and more particularly, to a connector mechanism capable of adjusting structural height.

2. Description of the Prior Art

With the development of information and computer technology, the size of a computer is becoming smaller and the computer is utilized in a wide variety of fields. In order to expand functions of a computer system for satisfying user's various demands, various external devices of the computer system come with the trend. For example, an external hard disk drive and a portable storage device can expand the memory capacity of the computer system. An external optical disk drive and an optical disk writer can expand multimedia access function of the computer system. A network cable allows the computer system to be connected to an internet so as to gather information online or surf webpage. However, because of the thinning size of the notebook computer, it brings more challenges for mechanical design. Connecting ports disposed on a side of the notebook computer will constrain the thickness of mechanism of the notebook computer.

For example, an Ethernet port (such as a Rj 45 port) for connecting to network or Rj11 port for connecting a telephone cable has a fixed size of the opening. So, the notebook computer needs to increase its thickness in order to match the size of the connecting ports. Alternatively, the network port or the telephone port is exposed out of the notebook computer so as to affect an aesthetic feeling of appearance. Thus, the conventional connector mechanism has importance issues of satisfying the height specification as well as keeping the aesthetic feeling of appearance.

SUMMARY OF THE INVENTION

The present disclosure provides a connector mechanism capable of adjusting structural height and a related thin electronic device for solving above drawbacks.

According to the claimed disclosure, a connector mechanism includes a foundation, a cover and a resilient component. The foundation includes a first base, a second base and a third base. The first base includes a connecting terminal. The second base is connected to a first side of the first base, and a pivot hole is formed on the second base. The third base is connected to a second side of the first base opposite to the first side. An opening is formed on the foundation and located between the first base, the second base and the third base. An external plug is for inserting into the opening to electrically connect to the connecting terminal. The cover is pivotably disposed on the second base and the third base. The cover includes a first portion, a second portion and at least one axle. The first portion rotates relative to the foundation to be at a first position for covering the opening, and further rotates relative to the foundation to be at a second position different from the first position for holding a body of the external plug. The axle is disposed between the first portion and the second portion and pierces through the pivot hole on the second base. The first base rotates relative to the foundation via the axle. The resilient component is disposed on the axle. Two ends of the resilient component respectively contact against the foundation and the cover, and a resilient recovering force of the resilient component puts the cover over the opening on the foundation.

According to the claimed disclosure, a height of the opening is substantially smaller than a height amount of the body and the pin.

According to the claimed disclosure, a distance between the first base and a bottom of the buckling structure is substantially equal to a height amount of the body and the pin.

According to the claimed disclosure, the first portion includes a sunken structure, the pin is accommodated inside the sunken structure when the body inserts into the opening.

According to the claimed disclosure, the sunken structure is connected to the buckling structure.

According to the claimed disclosure, a U-shaped structure is formed by the first base, the second base and the third base, and an accommodating space is formed inside the U-shaped structure.

According to the claimed disclosure, the second portion is accommodated inside the accommodating space when the first base rotates to the first position.

According to the claimed disclosure, the second portion is separated from the accommodating space when the first base rotates to the second position, and the buckling structure points toward the first base.

According to the claimed disclosure, a slide slot is formed on a surface of the second base, the cover further includes a guide block disposed on a lateral side of the first portion and piercing through the slide slot, an end of the resilient component buckles the guide block so as to rotate the first portion relative to the foundation.

According to the claimed disclosure, an arc length of the slide slot corresponds to an angle of the first portion between the first position and the second position.

According to the claimed disclosure, an electronic device includes a casing and a connector mechanism. At least one electronic component is disposed inside the casing. The connector mechanism is disposed inside the casing for connecting to an external plug. The external plug has a body and a pin. The connector mechanism includes a foundation, a cover and a resilient component. The foundation includes a first base, a second base and a third base. The first base includes a connecting terminal. The second base is connected to a first side of the first base, and a pivot hole is formed on the second base. The third base is connected to a second side of the first base opposite to the first side. An opening is formed on the foundation and located between the first base, the second base and the third base. The external plug is for inserting into the opening to electrically connect to the connecting terminal. The cover is pivotably disposed on the second base and the third base. The cover includes a first portion, a second portion and at least one axle. The first portion rotates relative to the foundation to be at a first position for covering the opening, and further rotates relative to the foundation to be at a second position different from the first position for holding the body of the external plug. The axle is disposed between the first portion and the second portion and pierces through the pivot hole on the second base. The first base rotates relative to the foundation via the axle. The resilient component is disposed on the axle. Two ends of the resilient component respectively contact against the foundation and the cover, and a resilient recovering force of the resilient component puts the cover over the opening on the foundation.

According to the claimed disclosure, a connector mechanism includes a foundation, a guide bar, a latch and a resilient component. A connecting terminal and a constraining slot are disposed inside the foundation. The connecting terminal is disposed on a rear of the constraining slot, and an external plug is for moving along the constraining slot to electrically connect to the connecting terminal. A first end of the guide bar is rotatably disposed on the foundation. The latch is pivotably disposed on the foundation. The latch includes a supporting portion, at least one connecting portion and a track structure. The supporting portion includes at least one support surface for holding a body of the external plug. The connecting portion is disposed on an edge of the supporting portion. The connecting portion pivots to a lateral wall of the foundation, and the connecting portion moves relative to the foundation within a gap formed between the lateral wall and the constraining slot. The track structure is disposed on the connecting portion. A second end of the guide bar different from the first end is slidably disposed inside the track structure. The latch is partly accommodated inside the foundation when the second end slides to a first stop of the track structure, and the latch is separated from the foundation when the second end slides to a second stop of the track structure different from the first stop, so that the external plug is disposed between the foundation and the latch. Two ends of the resilient component respectively contact against the foundation and the latch, and a resilient recovering force of the resilient component moves the latch away from the foundation.

According to the claimed disclosure, a distance between the foundation and the latch is substantially smaller than a height amount of the body and the pin when the guide bar slides to the first stop.

According to the claimed disclosure, the supporting portion of the latch further includes a sunken structure and a buckling structure. The sunken structure is disposed by the support surface. The buckling structure is disposed on a bottom of the sunken structure. The buckling structure is for buckling the pin of the external plug, so as to constrain a movement of the external plug relative to the foundation.

According to the claimed disclosure, a distance between the foundation and the bottom of the buckling structure is substantially equal to a height amount of the body and the pin when the guide bar slides to the second stop.

According to the claimed disclosure, the track structure further includes a first channel and a second channel respectively connected between the first stop and the second stop along different paths.

According to the claimed disclosure, the second end of the guide bar moves from the first stop to the second stop through the first channel, so that the latch is separated from the foundation, the second end further moves from the second stop to the first stop through the second channel, so that the latch is partly accommodated inside the foundation.

According to the claimed disclosure, the first channel includes a first part, a second part and a first relay, the first part is connected between the first stop and the first relay, the second part is connected between the first relay and the second stop, and a first descending stair structure is disposed on a path from the first part to the second part through the first relay.

According to the claimed disclosure, the second channel includes a third part, a fourth part and a second relay, the third part is connected between the second stop and the second relay, the fourth part is connected between the second relay and the first stop, and a second descending stair structure is disposed on a path from the third part to the fourth part through the second relay.

According to the claimed disclosure, a third descending stair structure is disposed on a path from the second part to the third part through the second stop, and a fourth descending stair structure is disposed on a path from the fourth part to the first part through the first stop.

According to the claimed disclosure, the connector mechanism further includes a plank. Two ends of the plank are respectively disposed on the foundation and movably contacting against the guide bar.

According to the claimed disclosure, the plank is made of resilient material, a resilient recovering force of the plank presses the guide bar, so that the second end of the guide bar is accommodated inside the track structure.

According to the claimed disclosure, an electronic device includes a casing and a connector mechanism. At least one electronic component is disposed inside the casing. The connector mechanism is disposed inside the casing for connecting to an external plug. The external plug has a body and a pin. The connector mechanism includes a foundation, a guide bar, a latch and a resilient component. A connecting terminal and a constraining slot are disposed inside the foundation. The connecting terminal is disposed on a rear of the constraining slot, and the external plug is for moving along the constraining slot to electrically connect to the connecting terminal. A first end of the guide bar is rotatably disposed on the foundation. The latch is pivotably disposed on the foundation. The latch includes a supporting portion, at least one connecting portion and a track structure. The supporting portion includes at least one support surface for holding the body of the external plug. The connecting portion is disposed on an edge of the supporting portion. The connecting portion pivots to a lateral wall of the foundation, and the connecting portion moves relative to the foundation within a gap formed between the lateral wall and the constraining slot. The track structure is disposed on the connecting portion. A second end of the guide bar different from the first end is slidably disposed inside the track structure. The latch is partly accommodated inside the foundation when the second end slides to a first stop of the track structure, and the latch is separated from the foundation when the second end slides to a second stop of the track structure different from the first stop, so that the external plug is disposed between the foundation and the latch. Two ends of the resilient component respectively contact against the foundation and the latch, and a resilient recovering force of the resilient component moves the latch away from the foundation.

The connector mechanism of the present disclosure utilizes the rotary cover relative to the foundation to adjust a dimension of the inserting slot (the opening) on the connector mechanism. The resilient component can drive the cover to put over the opening for preventing the dust from falling. After the cover is spaced from the opening, the sunken structure and the buckling structure of the cover can be connected to the opening, so as to expand the dimension of the inserting slot.

The latch of the connector mechanism of the present disclosure can pivot relative to the foundation, so as to movably adjust the volume of the connector mechanism. As the external plug is not in use, the volume of the connector mechanism can be minimized to be set inside the thin electronic device. As the external plug is in use, the latch can rotate to be spaced from the foundation, so as to expand the inserting slot of the connector mechanism. The combination of the guide bar and the track structure can be utilized to fold and to unfold the latch relative to the foundation. The track structure includes several structural units, such as the stops, the channels and the relays, according to the connector mechanism's demand, so that the connector mechanism can rotate the latch relative to the foundation in a push-push manner.

Thus, the connector mechanism of the present disclosure has advantages of simple structure, easy operation and low manufacturing cost, and the dimension of the inserting slot can be adjusted according to user's demand so as to apply to the thin electronic device suitably. The connector mechanism of the present disclosure has preferred artistic appearance and better market competition.

These and other objectives of the present disclosure will no doubt become obvious to those of ordinary skill in the art after reading the following detailed description of the preferred embodiment that is illustrated in the various figures and drawings.

DETAILED DESCRIPTION

Figure 1:
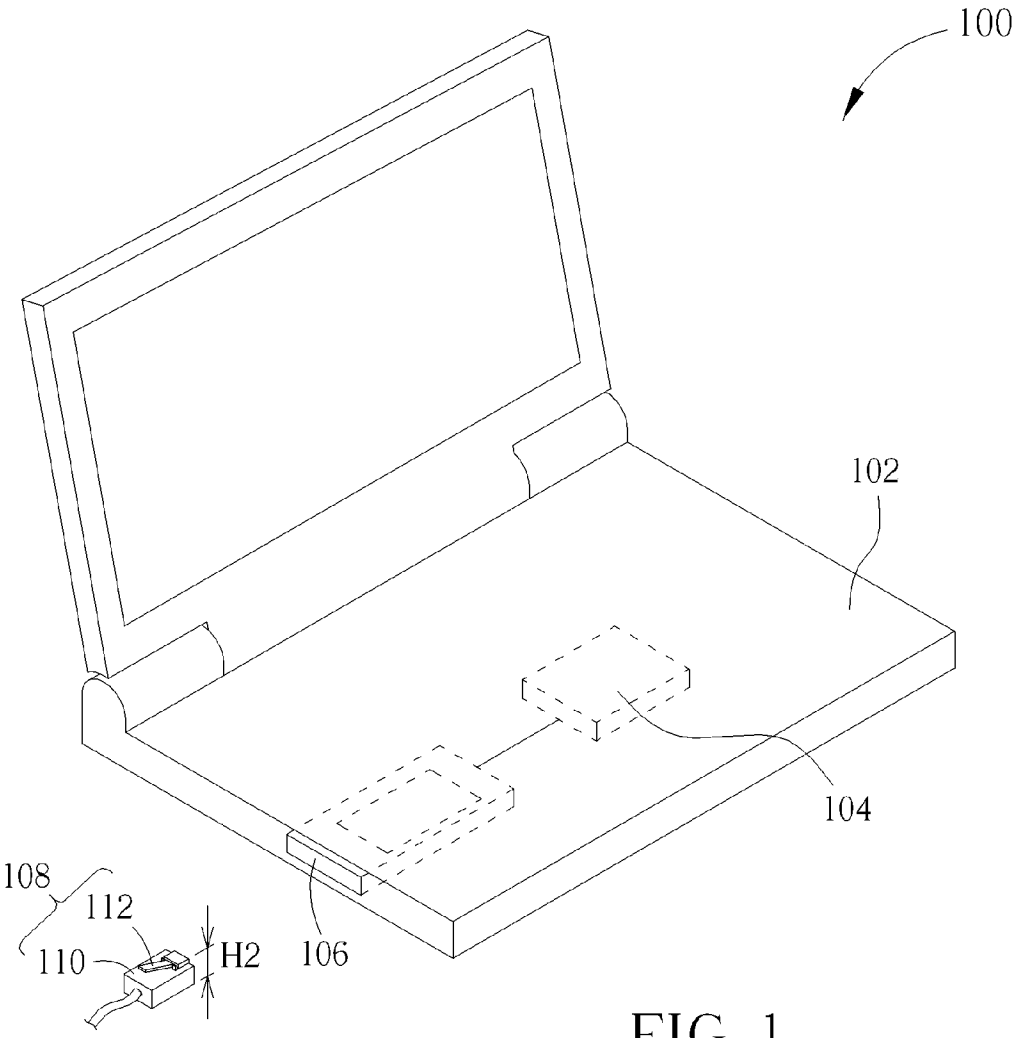
FIG. 1 is a diagram of an electronic device according to an embodiment of the present disclosure.

Please refer to FIG. 1. FIG. 1 is a diagram of an electronic device 100 according to an embodiment of the present disclosure. The electronic device 100 can be a desktop computer, a notebook computer, a tablet computer and so on. The electronic device 100 includes a casing 102, and a plurality of electronic components 104 is disposed inside the casing 102. The electronic component 104 can be a hard disc, an optical disc driver, a processor, a main board and so on. The electronic device 100 includes a connector mechanism 106 disposed inside the casing 102 and electrically connected to the electronic component 104, such as the main board. An external plug 108 can insert into the connector mechanism 106 to electrically connect to the electronic component 104, so as to transmit an electrical signal. Generally, the external plug 108 includes a body 110 and a pin 112. The pin 112 is flexibly disposed on a surface of the body 110. When the body 110 inserts into the connector mechanism 106, the pin 112 is engaged with the connector mechanism 106, so as to prevent the external plug 108 from falling from the connector mechanism 106.

Figure 2:
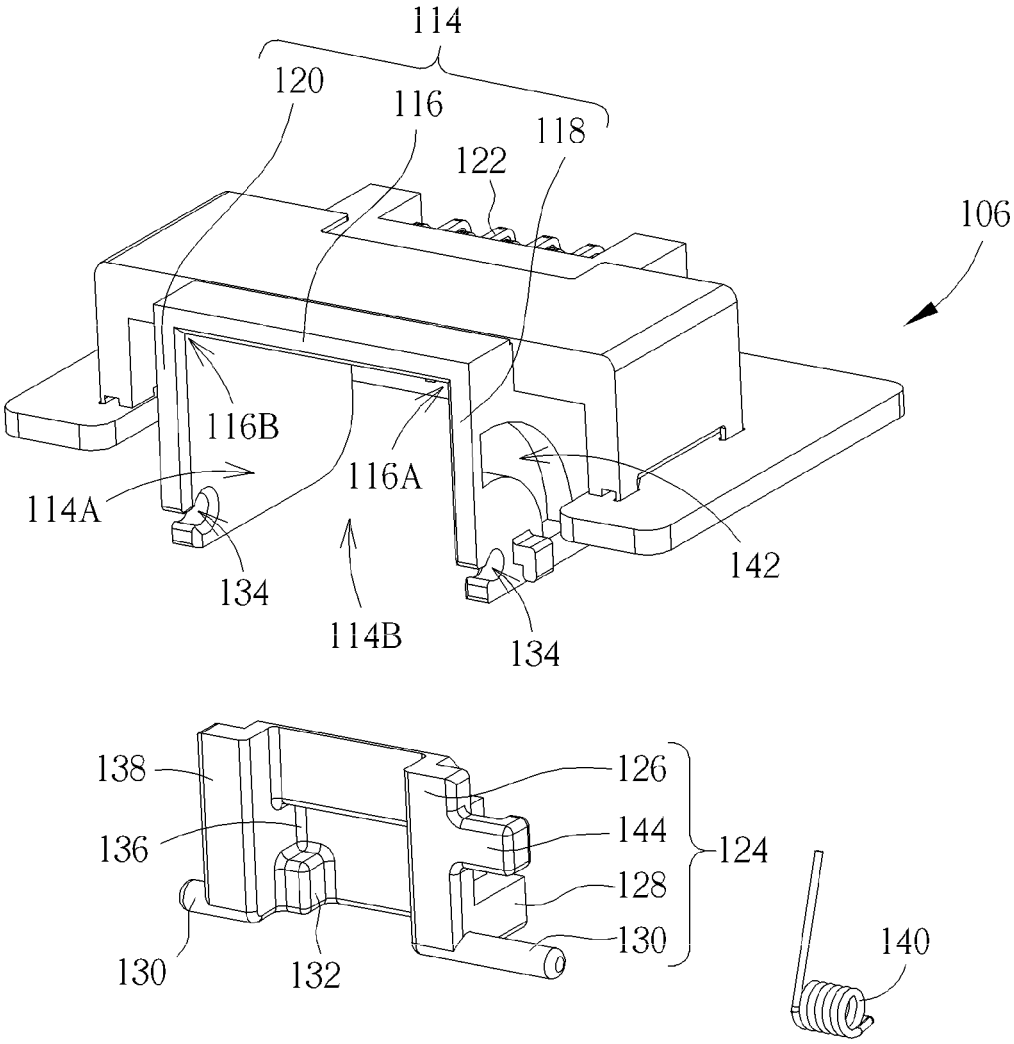
FIG. 2 is an exploded diagram of the connector mechanism according to the embodiment of the present disclosure.
Figure 3:
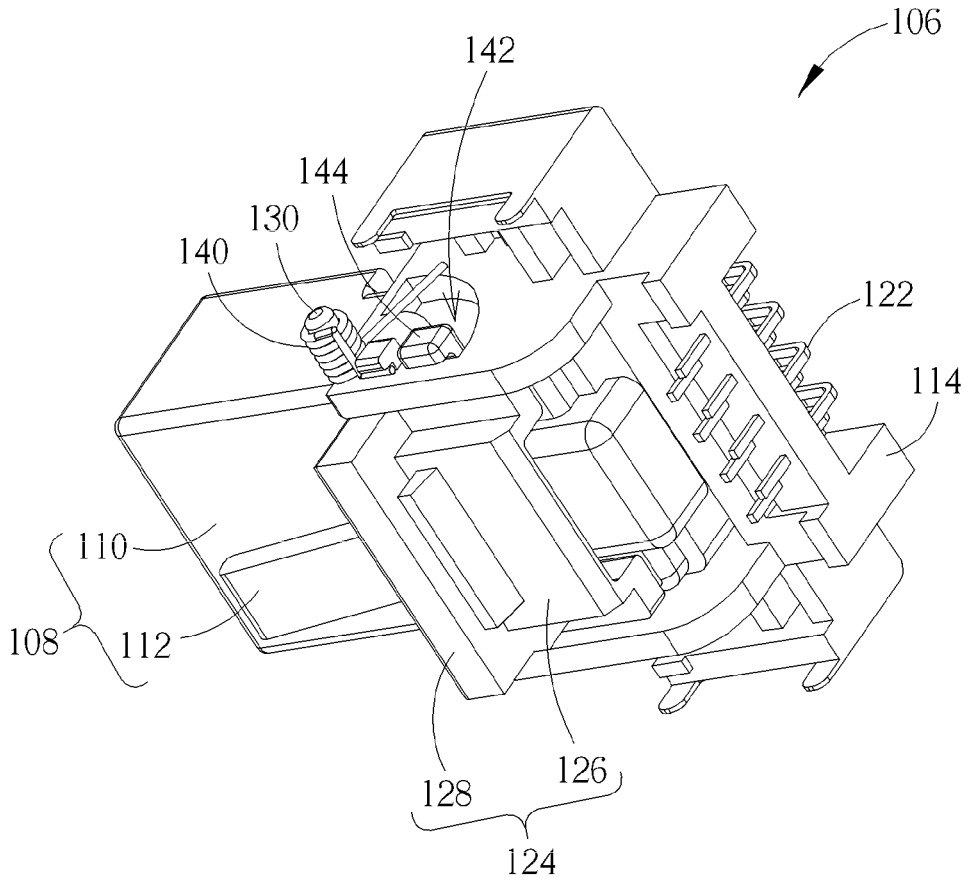
FIG. 3 is an assembly diagram of the connector mechanism and the external plug according to the embodiment of the present disclosure.

Please refer to FIG. 2 and FIG. 3. FIG. 2 is an exploded diagram of the connector mechanism 106 according to the embodiment of the present disclosure. FIG. 3 is an assembly diagram of the connector mechanism 106 and the external plug 108 according to the embodiment of the present disclosure. The connector mechanism 106 includes a foundation 114. The foundation 114 includes a first base 116, a second base 118 and a third base 120. The first base 116 includes a connecting terminal 122 electrically connected to the electronic component 104. The second base 118 and the third base 120 are respectively connected to a first side 116A and a second side 116B of the first base 116. The first side 116A and the second side 116B are two opposite sides of the first base 116, so that a combination of the first base 116, the second base 118 and the third base 120 can be a U-shaped structure. An opening 114A is formed on the foundation 114, and is located between adjacent sides of the first base 116, the second base 118 and the third base 120. An accommodating space 114B is formed inside the foundation 114 (the U-shaped structure). The accommodating space 114B is a rectangular space surrounding by the first base 116, the second base 118 and the third base 120. It is to say, the opening 114A is an aspect of the rectangular space (the accommodating space 114B), and the external plug 108 can passes into the opening 114A to be accommodated inside the accommodating space 114B for electrically connecting to the connecting terminal 122.

Figure 4:
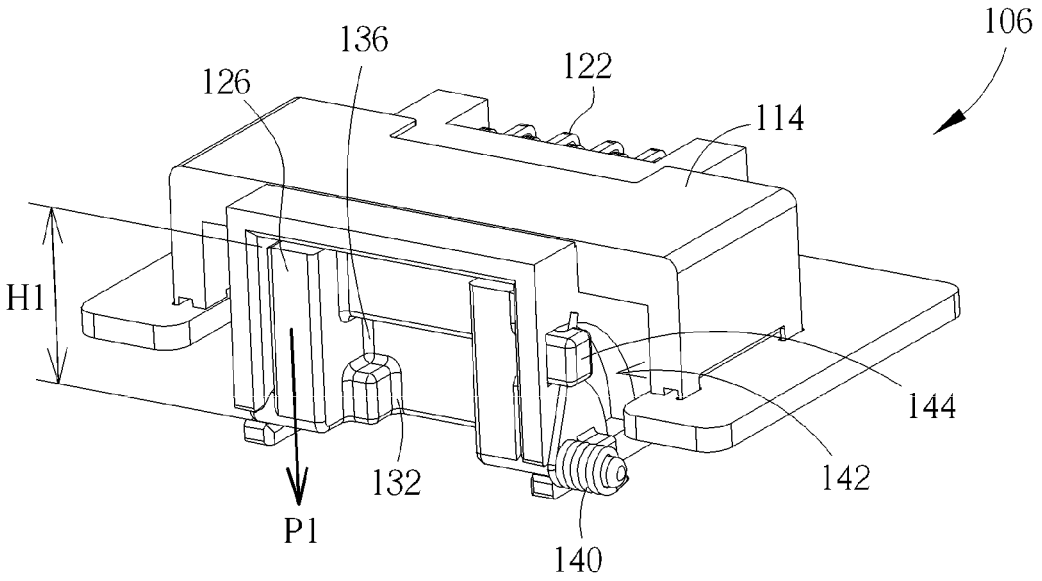
FIG. 4 and FIG. 5 respectively are diagrams of the connector mechanism in different modes according to the embodiment of the present disclosure.
Figure 5:
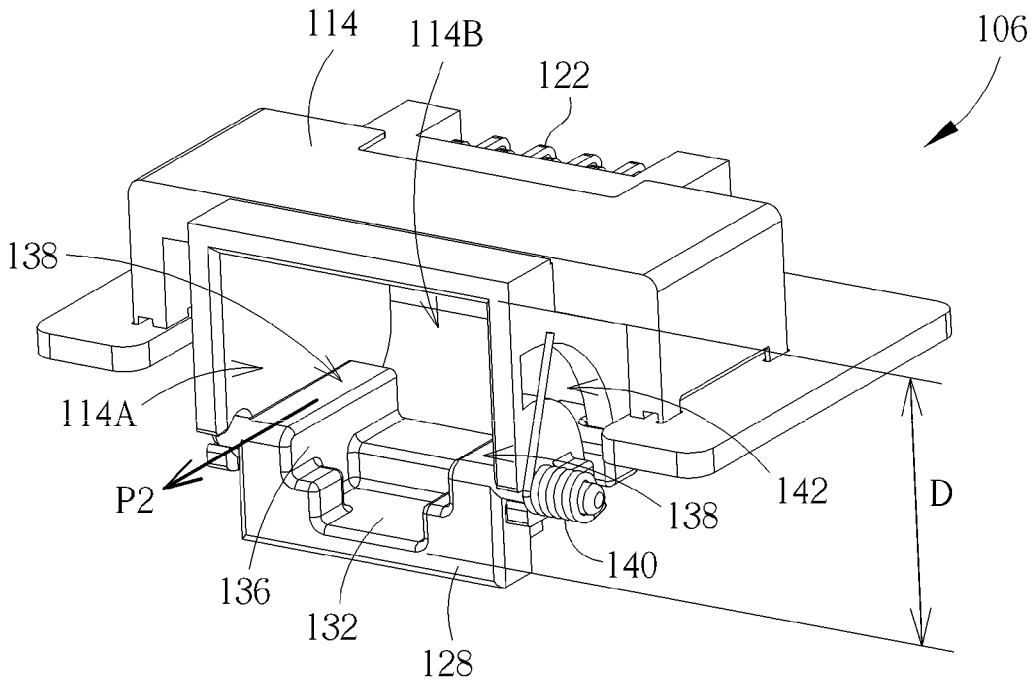

Please refer to FIG. 2 and FIG. 4 to FIG. 5. FIG. 4 and FIG. 5 respectively are diagrams of the connector mechanism 106 in different modes according to the embodiment of the present disclosure. The connector mechanism 106 further includes a cover 124 pivotably disposed on the second base 118 and the third base 120. The cover 124 includes a first portion 126, a second portion 128 and two axles 130. As shown in FIG. 4 and FIG. 5, the first portion 126 can rotate relative to the foundation 114 to be switched between a first position P1 and a second position P2. The first portion 126 rotates to the first position P1 for covering the opening 114A, so as to prevent dust from falling into the accommodating space 114B of the connector mechanism 106. The first portion 126 further rotates to the second position P2 for exposing the opening 114A, and the first portion 126 can hold the body 110 of the external plug 108 when the external plug 108 inserts into the opening 114A.

The second portion 128 is connected to the first portion 126. The second portion 128 includes a buckling structure 132. As the first portion 126 rotates to the second position P2, the buckling structure 132 can buckle the pin 112 of the external plug 108 when the external plug 108 inserts into the opening 114A, so as to constrain a movement of the external plug 108 relative to the foundation 114. The two axles 130 are respectively disposed on two ends of a boundary between the first portion 126 and the second portion 128. Pivot holes 134 can be respectively formed on the second base 118 and the third base 120, and the two axles 130 respectively pierce through the corresponding pivot hole 134, so that the cover 124 can rotate relative to the foundation 114 via a combination of the axle 130 and the pivot hole 134. In addition, the first portion 126 can include a sunken structure 136 selectively connected to the buckling structure 132. The sunken structure 136 can be formed on a central area of the first portion 126, and is located at a position corresponding to the pin 112 when the external plug 108 inserts into the opening 114A. The first portion 126 can further include two support surfaces 138 disposed on two sides of the sunken structure 136. As the external plug 108 inserts into the opening 114A, the body 110 can contact against the support surfaces 138, the pin 112 can be accommodated inside the sunken structure 136 and engaged with the buckling structure 132, so as to ensure that the external plug 108 can stably fix inside the connector mechanism 106.

Besides, the connector mechanism 106 further includes at least one resilient component 140 disposed on one of the axles 130. For example, the resilient component 140 of the present disclosure can be a torsional spring. Two ends of the resilient component 140 respectively contact against the foundation 114 and the cover 124. As shown in FIG. 4 and FIG. 5, the cover 124 moves from the first position P1 to the second position P2, the resilient component 140 is compressed to store a resilient recovering force. As an external force applied to the cover 124 is removed, the resilient recovering force of the resilient component 140 can rotate the cover 124 from the second portion P2 to the first position P1, so as to move back to an initial state covering on the opening 114A.

For smoothly rotating the cover 124 relative to the foundation 114, a slide slot 142 can be formed on a surface of the second base 118. The cover 124 can further include a guide block 144 disposed on a lateral side of the first portion 126. The guide block 144 can pierce through the slide slot 142 to protrude from the foundation 114. An end of the resilient component 140 can buckle the guide block 144, so that the resilient recover force of the resilient component 140 can move the guide block 144 along the slide slot 142 for guiding a rotation of the cover 124. An arc length of the slide slot 142 corresponds to an angle of the first portion 126 between the first position P1 and the second position P2. Generally, a rotary angle of the first portion 126 can be substantially equal to 90 degrees, and the slide slot 142 can be substantially equal to a quarter periphery of an arc structure.

As shown in FIG. 1 and FIG. 4, a height H1 of the opening 114A on the foundation 114 can be substantially smaller than a height amount H2 of the body 110 and the pin 112 of the external plug 108. When the cover 124 rotates to the first position P1 to cover the opening 114A, the second portion 128 is accommodated inside the accommodating space 114B, and a thickness of the connector mechanism 106 can be smaller than a thickness of the external plug 108, so that a dimension of the casing 102 of the electronic device 100 can be effectively minimized. The connector mechanism 106 of the present disclosure can be preferably applied to the thin computer. As shown in FIG. 1 and FIG. 5, a distance D between the first base 116 and a bottom of the buckling structure 132 can be substantially equal to the height amount H2 of the body 110 and the pin 112. When the cover 124 is separated from the opening 114A (the cover 124 rotates to the second position P2 to hide an exit of the U-shaped structure), the second portion 128 moves away from the accommodating space 114B, and the buckling structure 132 can point toward the first base 116, which means the opening 114A, the buckling structure 132 and the sunken structure 136 are connected to each other. Meanwhile, the external plug 108 can insert into the accommodating space 114B of the connector mechanism 106 via the opening 114A, and is electrically connected to the connecting terminal 122.

Figure 6:
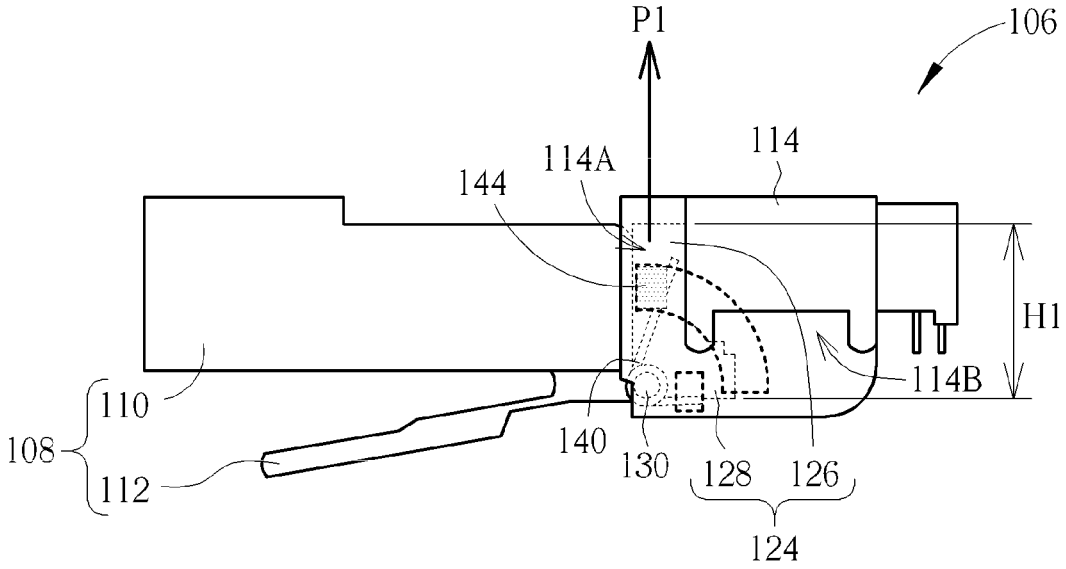
FIG. 6 to FIG. 8 respectively are sectional views of the connector mechanism in different modes according to the embodiment of the present disclosure.
Figure 7:
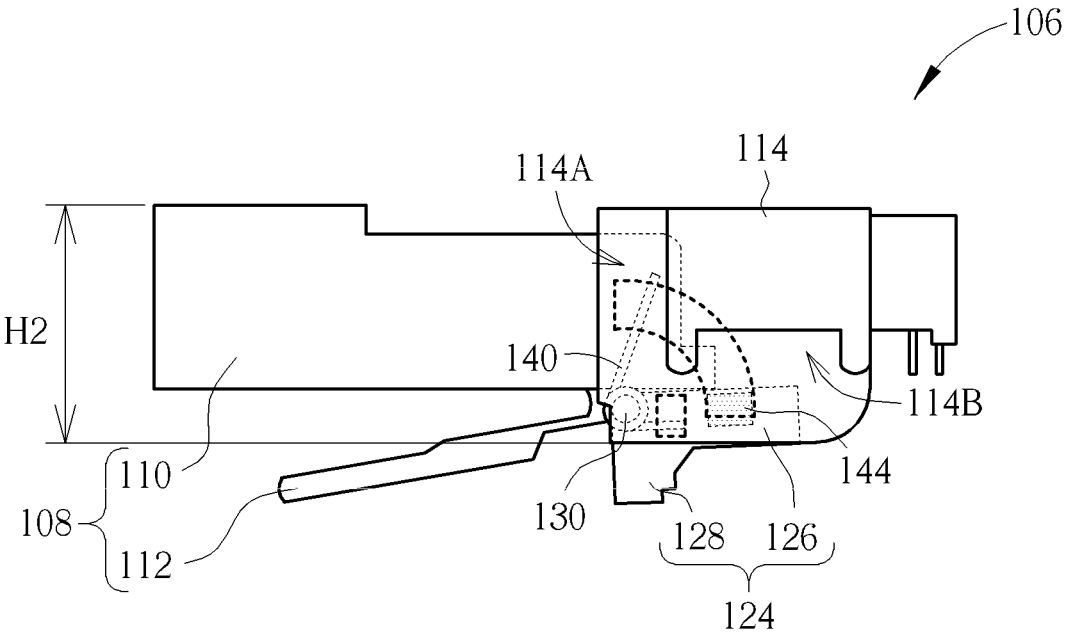
Figure 8:
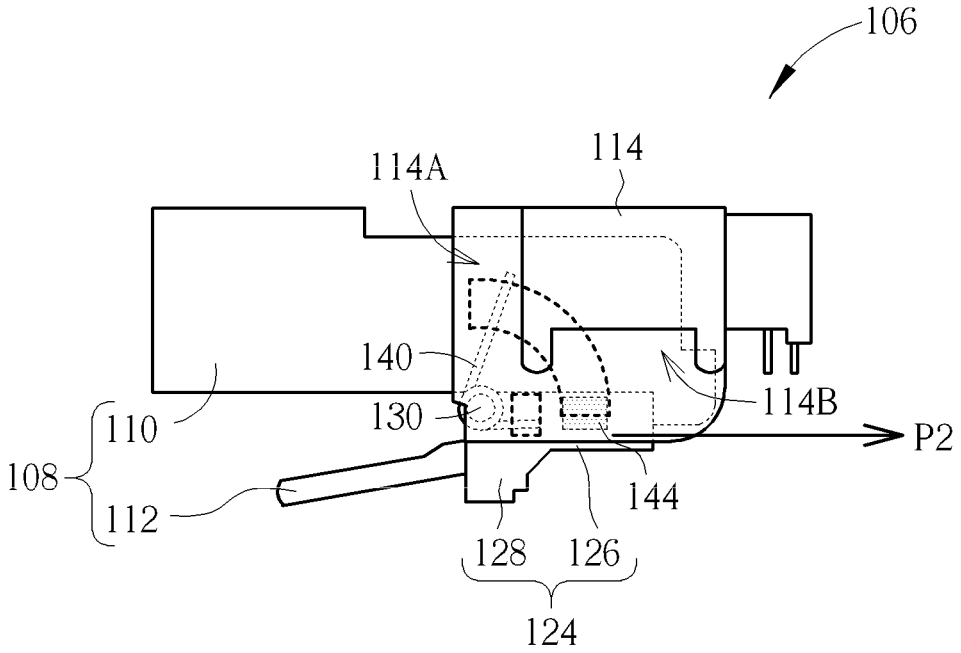

Please refer to FIG. 2, FIG. 3, and FIG. 6 to FIG. 8. FIG. 6 to FIG. 8 respectively are sectional views of the connector mechanism 106 in different modes according to the embodiment of the present disclosure. As shown in FIG. 6, the external plug 108 does not insert into the connector mechanism 106, the resilient component 140 drives the cover 124 to put over the opening 114A (the first position P1), and the cover 124 is fully accommodated inside the accommodating space 114B of the foundation 114. The thickness of the connector mechanism 106 is equal to the height H1 of the opening 114A, so the volume of the connector mechanism 106 can be minimized. As shown in FIG. 7, the external plug 108 partly inserts into the opening 114A. The dimension of the external plug 108 (which equals the height amount H2) is greater than the thickness of the connector mechanism 106 (which equals the height H1 of the opening 114), the body 110 pushes the first portion 126 away from the opening 114A to compress the resilient component 140, and the first portion 126 can rotate from the first position P1 to the second position P2 via the combination of the axle 130 and the pivot hole 134. At the time, the second portion 128 is spaced from the accommodating space 114B, and the pin 112 of the external plug 108 can slide into the sunken structure 136. As shown in FIG. 8, the external plug 108 completely inserts into the connector mechanism 106 and is electrically connected to the connecting terminal 122, the first portion 126 rotates relative to the foundation 114 at the maximal angle (the second position P2), so that the body 110 of the external plug 108 can contact against the support surfaces 138, and the pin 112 can buckle the buckling structure 132. Therefore, the external plug 108 can stably fix on the connector mechanism 106.

Comparing to the prior art, the connector mechanism of the present disclosure utilizes the rotary cover relative to the foundation to adjust a dimension of the inserting slot (the opening) on the connector mechanism. The resilient component can drive the cover to put over the opening for preventing the dust from falling. After the cover is spaced from the opening, the sunken structure and the buckling structure of the cover can be connected to the opening, so as to expand the dimension of the inserting slot.

Figure 9:
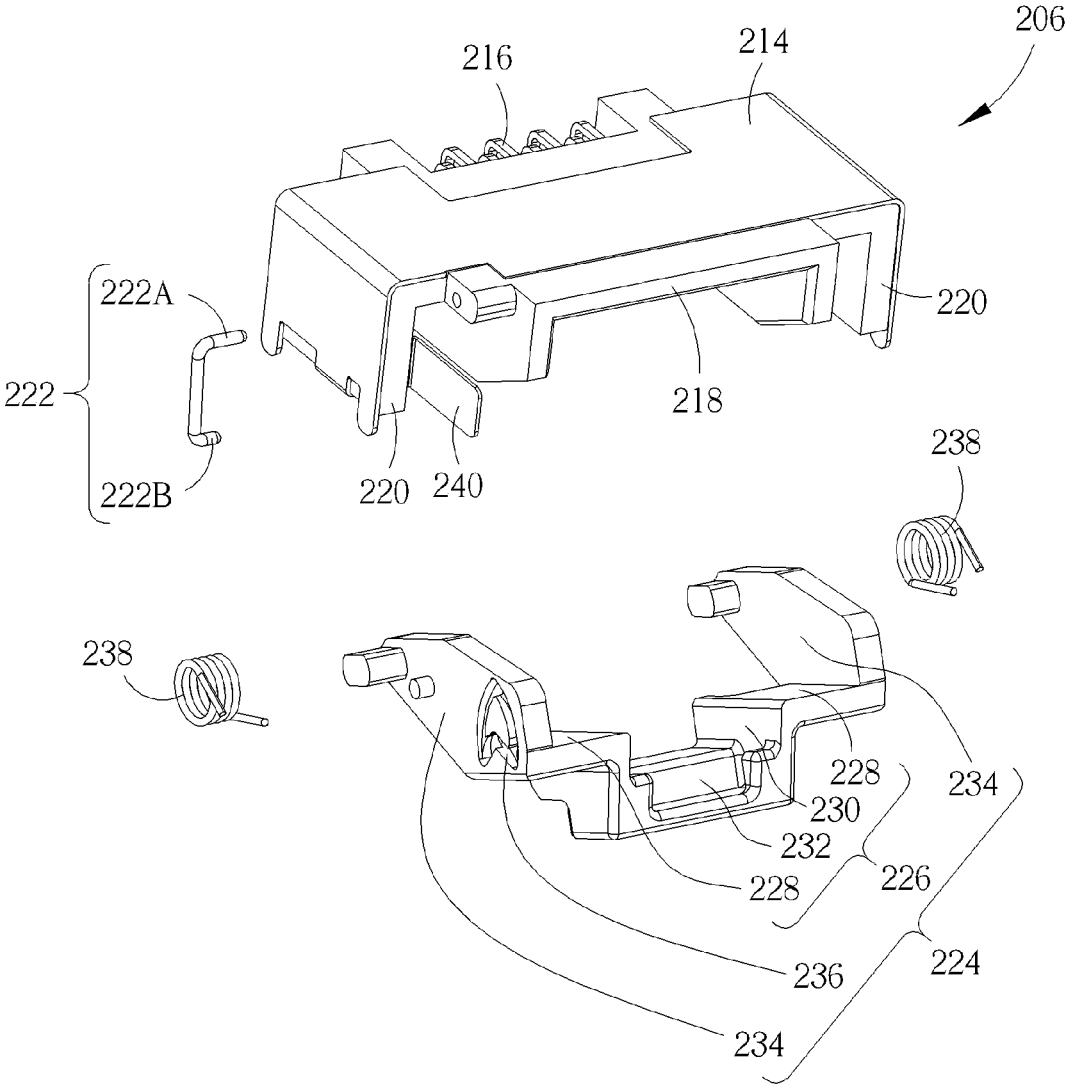
FIG. 9 is an exploded diagram of the connector mechanism according to the embodiment of the present disclosure.
Figure 10:
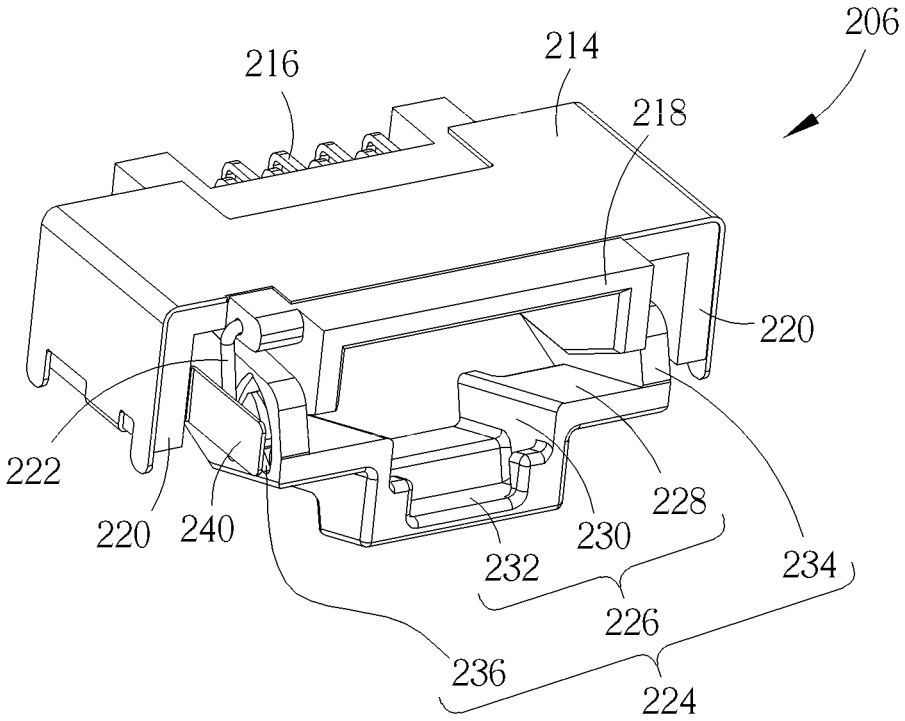
FIG. 10 is an assembly diagram of the connector mechanism according to the embodiment of the present disclosure.

Please refer to FIG. 9 and FIG. 10. FIG. 9 is an exploded diagram of the connector mechanism 206, and is the connector mechanism 106 in FIG. 1 according to another embodiment of the present disclosure. FIG. 10 is an assembly diagram of the connector mechanism 206 according to the embodiment of the present disclosure. The connector mechanism 206 includes a foundation 214. A connecting terminal 216, a constraining slot 218 and the two lateral walls 220 are disposed inside the foundation 214. The constraining slot 218 is disposed between the two lateral walls 220. The constraining slot 218 can constrain a moving track of the external plug 108 in FIG. 1 relative to the foundation 214 when the external plug 108 in FIG. 1 inserts into the connector mechanism 206. The connecting terminal 216 is disposed on a rear of the constraining slot 218 and electrically connected to the electronic device 104 in FIG. 1. Thus, the external plug 108 in FIG. 1 moves along the constraining slot 218 to electrically connect to the connecting terminal 216. The connector mechanism 206 further includes a guide bar 222, and a first end 222A of the guide bar 222 is rotatably disposed on the foundation 214.

In addition, the connector mechanism 206 further includes a latch 224 pivotably disposed on the foundation 214. The latch 224 includes a supporting portion 226. The supporting portion 226 includes two support surfaces 228, a sunken structure 230 and a buckling structure 232. The support surfaces 228 can hold the body 110 of the external plug 108 in FIG. 1. The sunken structure 230 is disposed between the two support surfaces 228, and the buckling structure 232 is disposed on a bottom of the sunken structure 230. The buckling structure 232 can buckle the pin 112 of the external plug 108 in FIG. 1, so as to constrain the movement of the external plug 108 in FIG. 1 relative to the foundation 214. The latch 224 further includes two connecting portions 234 respectively disposed on two opposite sides of the supporting portion 226 and pivoting to the corresponding lateral walls 220 of the foundation 214. As the latch 224 pivots to the foundation 214, the connecting portion 234 moves within a gap formed between the lateral wall 220 and the constraining slot 218, so as to rotate relative to the foundation 214.

The latch 224 further includes a track structure 236 disposed on one of the connecting portions 234. A second end 222B of the guide bar 222 different from the first end 222A can be slidably disposed inside the track structure 236. It is to say, the first end 222A is a fix end, and the second end 222B is a free end. Besides, the connector mechanism 206 further includes at least one resilient component 238. Two ends of the resilient component 238 respectively contact against the foundation 214 and the latch 224, and the resilient recovering force of the resilient component 238 can move the latch 224 away from the foundation 214. The connector mechanism 206 can further include a plank 240. Two ends of the plank 240 are respectively disposed on the foundation 214, and movably contact against the guide bar 222. The plank 240 can be made of resilient material, and a resilient recovering force of the plank 240 can press the guide bar 222, so that the second end 222B of the guide bar 222 can keep staying inside the track structure 236. However, the guide bar 222 can further be made of the resilient material, so as to utilize the own resilient recovering force to stay inside the track structure 236. The plank 240 is a selected component.

Figure 11:
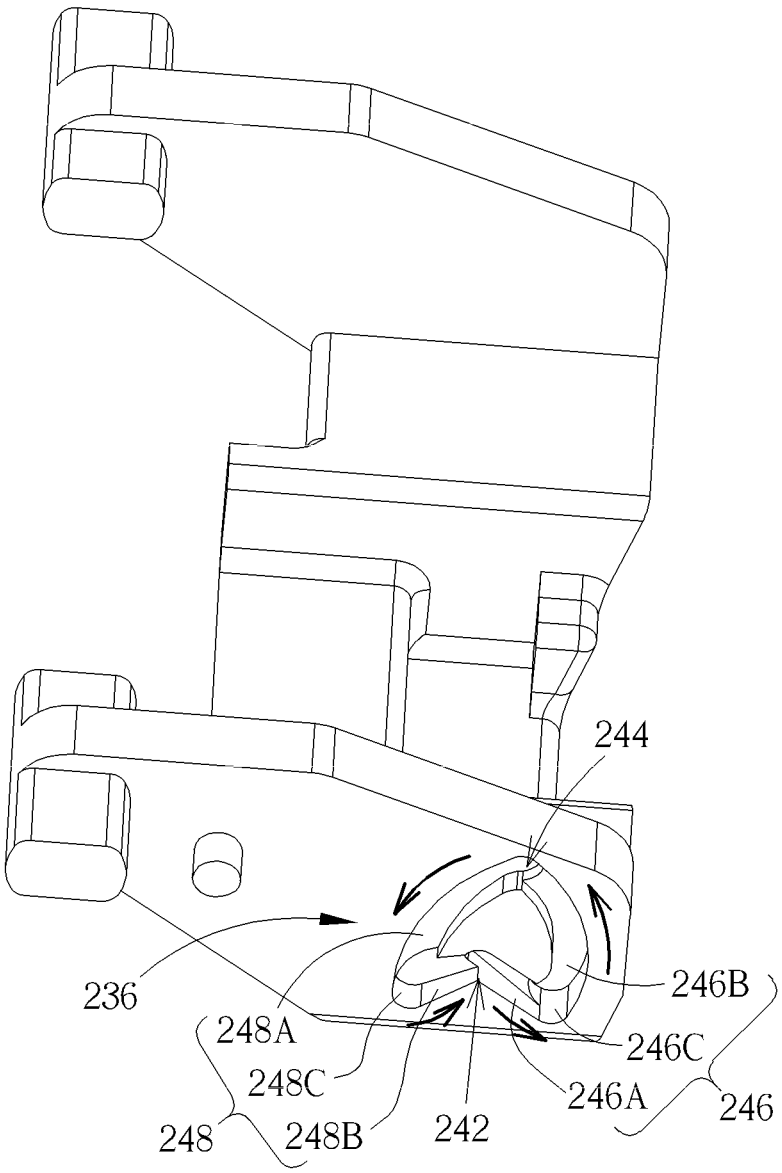
FIG. 11 is a diagram of the track structure according to the embodiment of the present disclosure.

Please refer to FIG. 11. FIG. 11 is a diagram of the track structure 236 according to the embodiment of the present disclosure. The track 236 includes a first stop 242, a second stop 244, a first channel 246 and a second channel 248. The first channel 246 and the second channel 248 can be respectively connected between the first stop 242 and the second stop 244 along different paths. As the second end 222B of the guide bar 222 moves to the first stop 242, the latch 224 can be partly accommodated inside the foundation 214, so as to prevent the dust from falling into the connector mechanism 206, and to minimize the volume (height) of the connector mechanism 206. In addition, when the second end 222B moves to the second stop 244, the latch 224 is spaced from the foundation 214, a distance between the latch 224 and the foundation 214 is enlarged, so that the external plug 108 can insert into the connector mechanism 206 via a gap between the latch 224 and the foundation 214.

As shown in FIG. 11, the first channel 246 can include a first part 246A, a second part 246B and a first relay 246C. The first part 246A is connected between the first stop 242 and the first relay 246C, and the second part 246B is connected between the first relay 246C and the second stop 244. A first descending stair structure is disposed on a path from the first part 246A to the second part 246B through the first relay 246C.

In addition, the second channel 246 can include a third part 248A, a fourth part 248B and a second relay 248C. The third part 248A is connected between the second stop 244 and the second relay 248C, and the fourth part 248B is connected between the second relay 248C and the first stop 242. A second descending stair structure is disposed on a path from the third part 248A to the fourth part 248B through the second relay 248C. Besides, a third descending stair structure is disposed on a path from the second part 246B to the third part 248A through the second stop 244, and a fourth descending stair structure is disposed on a path from the fourth part 248B to the first part 246A through the first stop 242.

It is to say, the first part 246A is an inclined structure from the first stop 242 (high) to the first relay 246C (low), the second part 246B is an inclined structure from the first relay 246C (high) to the second stop 244 (low), the third part 248A is an inclined structure from the second stop 244 (high) to the second relay 248C (low), and the fourth part 248B is an inclined structure from the second relay 248C (high) to the first stop 242 (low). The descending stair structures between the different parts can keep the guide bar 222 moving at a predetermined direction in the track structure 236. Thus, the guide bar 222 can slide inside the track structure 236 along an arrow shown in FIG. 11, the guide bar 222 can follow the inclined structures between the structural units of the track structure 236 (the stops, the relays and the parts), so that the connector mechanism 206 of the present disclosure can utilize a combination of the guide bar 222 and the track structure 236 to control operation of the latch 224 relative to the foundation 214.

Figure 12:
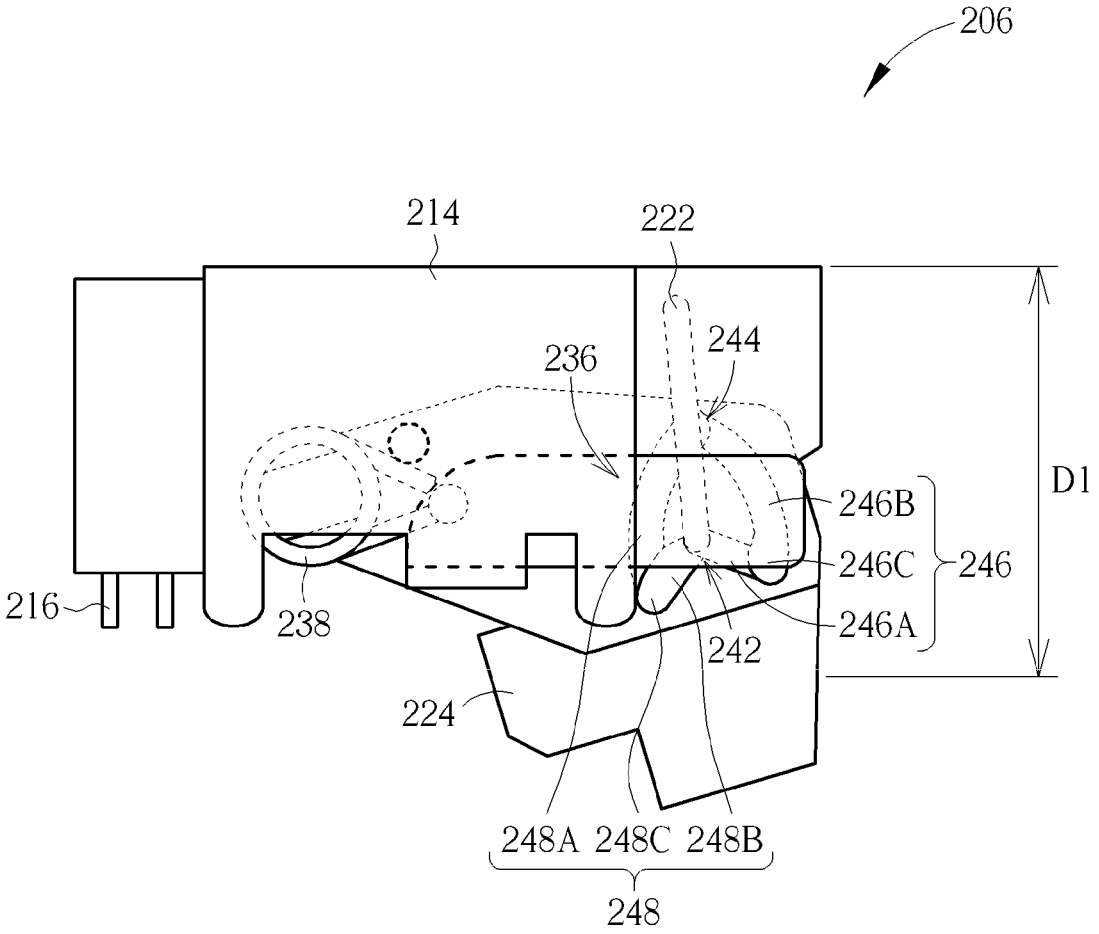
FIG. 12 to FIG. 16 respectively are sectional views of the connector mechanism in different operation modes according to the embodiment of the present disclosure.

Please refer to FIG. 12 to FIG. 16. FIG. 12 to FIG. 16 respectively are sectional views of the connector mechanism 206 in different operation modes according to the embodiment of the present disclosure. As shown in FIG. 12, the second end 222B of the guide bar 222 stays at the first stop 242, a distance D1 between the latch 224 and the foundation 214 is a minimum and is substantially smaller than the height amount of the body 110 and the pin 112 of the external plug 108 in FIG. 1. The external plug 108 can not insert into the connector mechanism 206, and the volume of the connector mechanism 206 can be minimized to apply to the thin electronic device 100.

Figure 13:
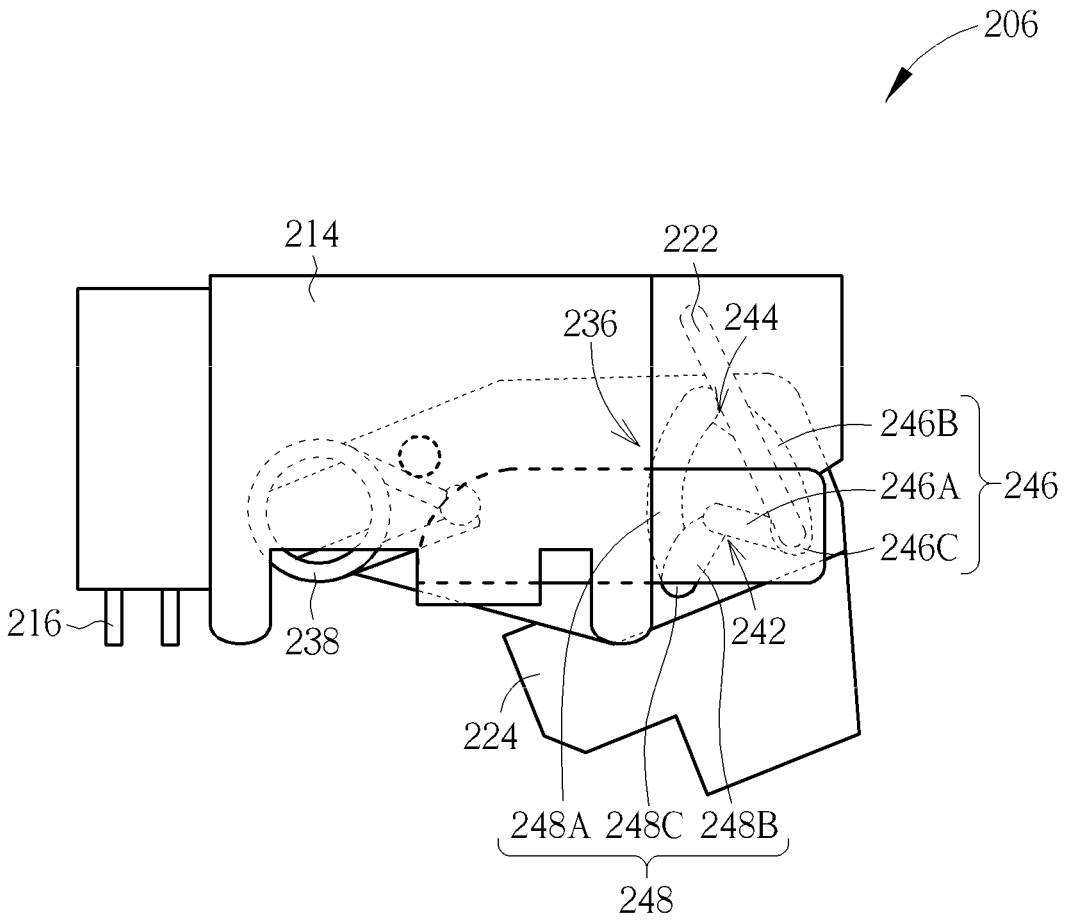
Figure 14:
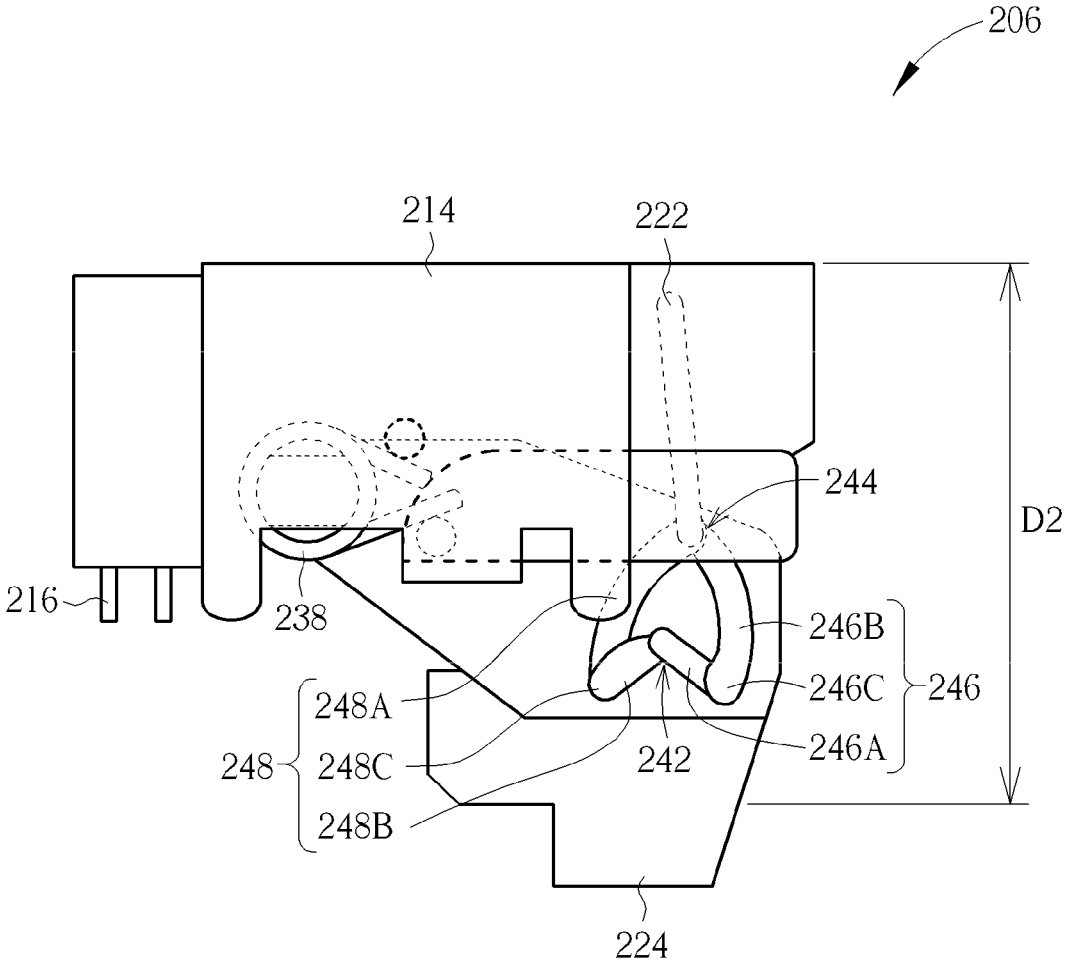
Figure 15:
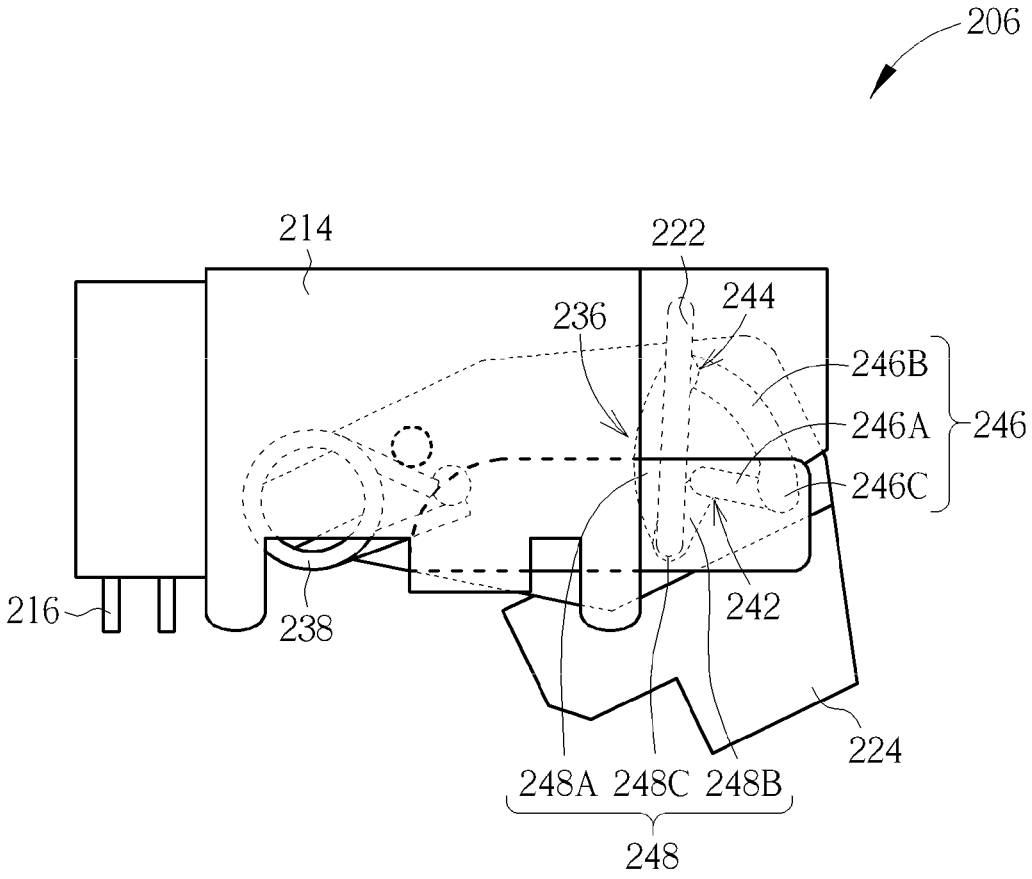

As shown in FIG. 13, the latch 224 can be pushed upwardly, the second end 222B of the guide bar 222 can move from the first stop 242 to the first relay 246C (and can not move to the second relay 248C due to the descending stair structure) along the first part 246A. The volume of the connector mechanism 206 can be reduced to the minimum. As the external force applied to the latch 224 is removed, the resilient component 238 can press the latch 224, as shown in FIG. 14, the connector mechanism 206 is open, the second end 222B of the guide bar 222 can move from the first relay 246C to the second stop 244 along the second part 246B, so that the latch 224 is spaced from the foundation 214, and the inserting slot (specially for the external plug 108 in FIG. 1) of the connector mechanism 206 is expanded to the maximum. As closing the connector mechanism 206, the guide bar 222 stays at the second stop 244, a distance D2 between the foundation 214 and the bottom of the buckling structure 232 can be substantially equal to the height amount of the body 110 and the pin 112. The external plug 108 can insert into the gap between the latch 224 and the foundation 214 to electrically connect to the connecting terminal 216. For closing the connector mechanism 206, the latch 224 can be pushed upwardly, as shown in FIG. 15, the second end 222B of the guide bar 222 can move from the second stop 244 to the second relay 248C along the third part 248A. At the time, the volume of the connector mechanism 206 is reduced to the minimum.

Figure 16:
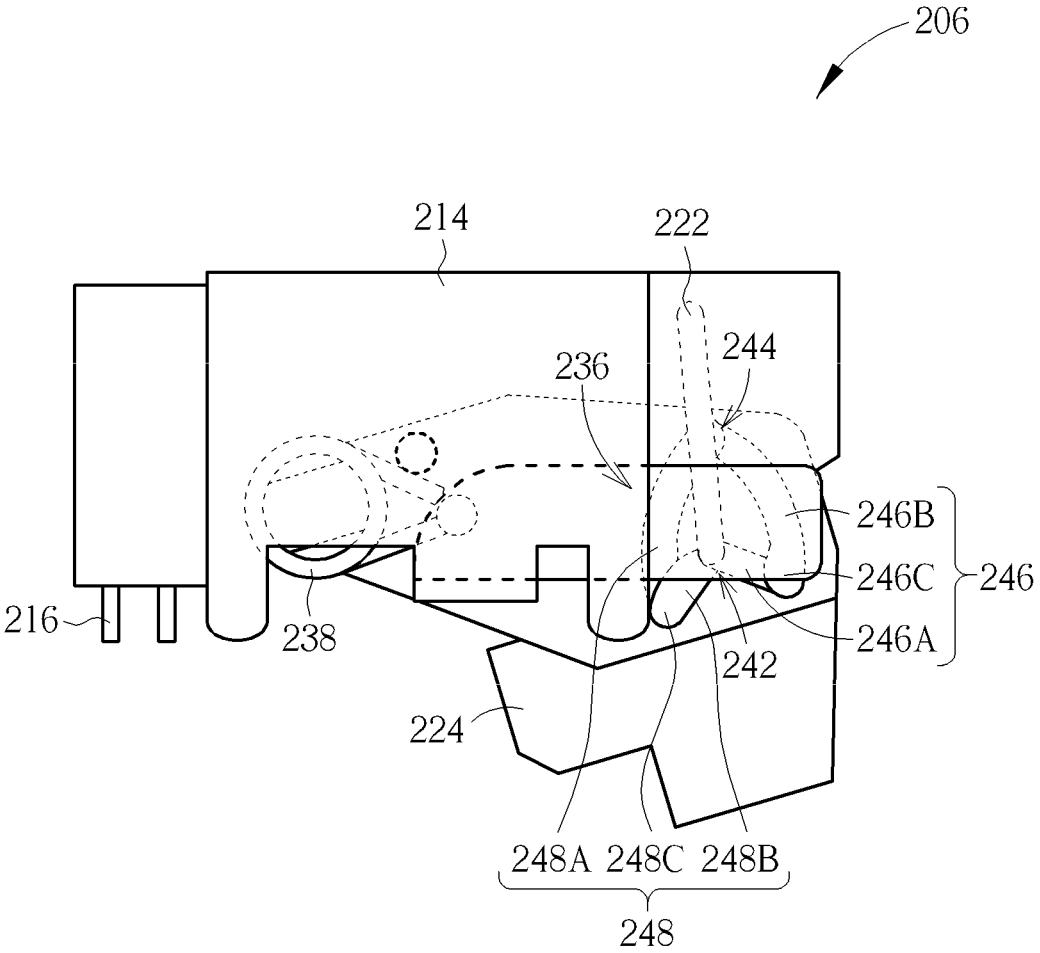

After the external force applied to the latch 224 is removed, the resilient component 238 can press the latch 224 to pivot relative to the foundation 214, as shown in FIG. 16, the second end 222B of the guide bar 222 can move from the second relay 248C to the first stop 242 along the fourth part 248B, so as to partly accommodate the latch 224 inside the foundation 214, and to minimize the volume of the connector mechanism 206. Therefore, the connector mechanism 206 of the present disclosure is widespread applied to the thin electronic device 100.

Comparing to the prior art, the latch of the connector mechanism of the present disclosure can pivot relative to the foundation, so as to movably adjust the volume of the connector mechanism. As the external plug is not in use, the volume of the connector mechanism can be minimized to be set inside the thin electronic device. As the external plug is in use, the latch can rotate to be spaced from the foundation, so as to expand the inserting slot of the connector mechanism. The combination of the guide bar and the track structure can be utilized to fold and to unfold the latch relative to the foundation. The track structure includes several structural units, such as the stops, the channels and the relays, according to the connector mechanism's demand, so that the connector mechanism can rotate the latch relative to the foundation in a push-push manner.

The connector mechanism of the present disclosure has advantages of simple structure, easy operation and low cost, and the dimension of the inserting slot can be adjusted according to user's demand, so as to apply to the thin electronic device suitably. The connector mechanism of the present disclosure has preferred artistic appearance and better market competition.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A connector mechanism comprising:

a foundation, the foundation comprising:

a first base, the first base comprising a connecting terminal;

a second base connected to a first side of the first base, a pivot hole being formed on the second base; and a third base connected to a second side of the first base opposite to the first side, an opening being formed on the foundation and located between the first base, the second base and the third base, an external plug being for inserting into the opening to electrically connect to the connecting terminal;

a cover pivotably disposed on the second base and the third base, the cover comprising:

a first portion rotating relative to the foundation to be at a first position for covering the opening, and further rotating relative to the foundation to be at a second position different from the first position for holding a body of the external plug;

a second portion connected to the first portion, the second portion comprising a buckling structure, the buckling structure being for buckling a pin of the external plug when the first base rotates to the second position, so as to constrain a movement of the external plug relative to the foundation; and at least one axle disposed between the first portion and the second portion and piercing through the pivot hole on the second base, the first base rotating relative to the foundation via the axle; and a resilient component disposed on the axle, two ends of the resilient component respectively contacting against the foundation and the cover, a resilient recovering force of the resilient component putting the cover over the opening on the foundation.

2. The connector mechanism of claim 1, wherein a height of the opening is substantially smaller than a height amount of the body and the pin.

3. The connector mechanism of claim 1, wherein a distance between the first base and a bottom of the buckling structure is substantially equal to a height amount of the body and the pin.

4. The connector mechanism of claim 1, wherein the first portion comprises a sunken structure, the pin is accommodated inside the sunken structure when the body inserts into the opening.

5. The connector mechanism of claim 4, wherein the sunken structure is connected to the buckling structure.

6. The connector mechanism of claim 1, wherein a U-shaped structure is formed by the first base, the second base and the third base, and an accommodating space is formed inside the U-shaped structure.

7. The connector mechanism of claim 6, wherein the second portion is accommodated inside the accommodating space when the first base rotates to the first position.

8. The connector mechanism of claim 6, wherein the second portion is separated from the accommodating space when the first base rotates to the second position, and the buckling structure points toward the first base.

9. The connector mechanism of claim 1, wherein a slide slot is formed on a surface of the second base, the cover further comprises a guide block disposed on a lateral side of the first portion and piercing through the slide slot, an end of the resilient component buckles the guide block so as to rotate the first portion relative to the foundation.

10. The connector mechanism of claim 9, wherein an arc length of the slide slot corresponds to an angle of the first portion between the first position and the second position.

11. A connector mechanism comprising:

a foundation, a connecting terminal and a constraining slot being disposed inside the foundation, the connecting terminal being disposed on a rear of the constraining slot, an external plug being for moving along the constraining slot to electrically connect to the connecting terminal;

a guide bar, a first end of the guide bar being rotatably disposed on the foundation;

a latch pivotably disposed on the foundation, the latch comprising:

a supporting portion, the supporting portion comprising:

at least one support surface for holding a body of the external plug; and at least one connecting portion disposed on an edge of the supporting portion, the connecting portion pivoting to a lateral wall of the foundation, and the connecting portion moving relative to the foundation within a gap formed between the lateral wall and the constraining slot; and a track structure disposed on the connecting portion, a second end of the guide bar different from the first end being slidably disposed inside the track structure, the latch being partly accommodated inside the foundation when the second end slides to a first stop of the track structure, the latch being separated from the foundation when the second end slides to a second stop of the track structure different from the first stop, so that the external plug is disposed between the foundation and the latch; and a resilient component, two ends of the resilient component respectively contacting against the foundation and the latch, a resilient recovering force of the resilient component moving the latch away from the foundation.

12. The connector mechanism of claim 11, wherein a distance between the foundation and the latch is substantially smaller than a height amount of the body and the pin when the guide bar slides to the first stop.

13. The connector mechanism of claim 11, wherein the supporting portion of the latch further comprises:

a sunken structure disposed by the support surface; and a buckling structure disposed on a bottom of the sunken structure, the buckling structure being for buckling the pin of the external plug, so as to constrain a movement of the external plug relative to the foundation.

14. The connector mechanism of claim 13, wherein a distance between the foundation and the bottom of the buckling structure is substantially equal to a height amount of the body and the pin when the guide bar slides to the second stop.

15. The connector mechanism of claim 11, wherein the track structure further comprises a first channel and a second channel respectively connected between the first stop and the second stop along different paths.

16. The connector mechanism of claim 15, wherein the second end of the guide bar moves from the first stop to the second stop through the first channel, so that the latch is separated from the foundation, the second end further moves from the second stop to the first stop through the second channel, so that the latch is partly accommodated inside the foundation.

17. The connector mechanism of claim 15, wherein the first channel comprises a first part, a second part and a first relay, the first part is connected between the first stop and the first relay, the second part is connected between the first relay and the second stop, and a first descending stair structure is disposed on a path from the first part to the second part through the first relay.

18. The connector mechanism of claim 17, wherein the second channel comprises a third part, a fourth part and a second relay, the third part is connected between the second stop and the second relay, the fourth part is connected between the second relay and the first stop, and a second descending stair structure is disposed on a path from the third part to the fourth part through the second relay.

19. The connector mechanism of claim 18, wherein a third descending stair structure is disposed on a path from the second part to the third part through the second stop, and a fourth descending stair structure is disposed on a path from the fourth part to the first part through the first stop.

20. The connector mechanism of claim 11, further comprising:

a plank, two ends of the plank being respectively disposed on the foundation and movably contacting against the guide bar.

21. The connector mechanism of claim 20, wherein the plank is made of resilient material, a resilient recovering force of the plank presses the guide bar, so that the second end of the guide bar is accommodated inside the track structure.

* * * * *